US006006794A

United States Patent [19]

Covelli

[11] Patent Number: 6,006,794

[45] Date of Patent: Dec. 28, 1999

[54] DEVICE TO BLOCK WEFT YARN DURING CUTTING ON A WEFT FEEDER

[75] Inventor: Marco Covelli, Occhieppo Inferiore, Italy

[73] Assignee: Nuova Roj Electrotex S.r.l., Biella, Italy

[21] Appl. No.: 09/043,651

[22] PCT Filed: Sep. 26, 1996

[86] PCT No.: PCT/EP96/04218

§ 371 Date: Mar. 25, 1998

§ 102(e) Date: Mar. 25, 1998

[87] PCT Pub. No.: WO97/12084

PCT Pub. Date: Apr. 3, 1997

[30] Foreign Application Priority Data

Sep. 27, 1995 [IT] Italy ..... M195A01983

[51] Int. Cl.[6] ..... D03D 47/34; B65H 59/22

[52] U.S. Cl. ..... 139/452; 139/194; 242/365.4; 335/272

[58] Field of Search ..... 139/194, 452, 139/450; 242/365.4, 150 M, 156.1, 147 M; 335/272

[56] References Cited

U.S. PATENT DOCUMENTS

| | | | |
|---|---|---|---|
| 4,494,579 | 1/1985 | Grandvallet et al. | 139/450 |
| 4,632,155 | 12/1986 | Maina | 139/452 |
| 5,016,681 | 5/1991 | Ghiardo | 139/452 |
| 5,462,096 | 10/1995 | Svanstrooem et al. | 139/452 |
| 5,590,693 | 1/1997 | Pedrini et al. | 139/452 |
| 5,623,973 | 4/1997 | Josefsson | 139/452 |
| 5,699,031 | 12/1997 | Covelli et al. | 335/272 |

FOREIGN PATENT DOCUMENTS

| | | |
|---|---|---|
| 0 239 055 | 9/1987 | European Pat. Off. . |
| 0 363 938 | 4/1990 | European Pat. Off. . |
| 0 622 485 | 11/1994 | European Pat. Off. . |
| 0 652 312 | 5/1995 | European Pat. Off. . |

*Primary Examiner*—Andy Falik
*Attorney, Agent, or Firm*—Young & Thompson

[57] ABSTRACT

Device to block weft yarn associated with a measuring weft feeder for fluid jet looms. The device is located downstream of the outlet yarn guide and/or of the antiballoon device of the feeder, and comprises a single elongated body which includes: an inlet cone and a cylindrical channel crossed by the weft yarn, the common axis of which is the longitudinal axis of the device; a core to block the yarn, movable into a guide perpendicularly to the axis and adapted to penetrate into the channel through an opening thereof; electromagnetic elements acting on the core against a return spring; and a bush associated to the channel, in correspondence of the opening, to form a contrast surface onto which the core engages in order to block the yarn.

7 Claims, 2 Drawing Sheets

DEVICE TO BLOCK WEFT YARN DURING CUTTING ON A WEFT FEEDER

FIELD OF THE INVENTION

The present invention concerns improvements in measuring weft feeders for fluid jet looms, namely those special weft yarn feeders from which the yarn is drawn by the main nozzle of the loom and the yarn turns being unwound from the weft feeder drum are counted through an appropriate system.

BACKGROUND OF THE INVENTION

As is known, in such feeders, the weft yarn inserted in the loom shed is stopped, after having reached the preset length, by a controlled device usually comprising a movable rod which engages the edge of the drum by penetrating with slack into a hole formed on said drum, the weft yarn stopping against said rod and being braked thereby.

The present invention proposes to solve the problems arising just after the weft yarn has been stopped and, in particular, to provide for an efficient blocking of said yarn just after it has been cut by the appropriate cutting devices of the loom.

It should be remembered that, for the loom cutting devices to correctly perform their function, it is necessary for the weft yarn length extending between the measuring weft feeder and the fabric being woven to be sufficiently tensioned at the moment in which it is being cut; consequently, since just after cutting there is a sudden decrease in weft yarn tension, this causes oscillations on the yarn starting from its cut end and travelling backwards to the point in which the yarn is blocked by the rod of the stopping device on the weft feeder drum. These oscillations may even continue up to involving the yarn turns wound on said drum.

These oscillations, turning on the yarn into strong transversal and longitudinal waves, may cause various inconveniences, such as:

a) Wedging-in of the weft yarn beneath the rod of the stopping device, when this latter is already acting into the drum hole.

b) Ruffling of the yarn turns wound on the drum, with possible overlapping thereof, whereby, during the next weft yarn insertion, the turns will no longer unwind regularly one at a time from the drum, but may be drawn by two or more turns at a time getting entangled at the outlet of the drum.

It is evident that, both in the first case and in the second case, measuring errors might occur, which may in turn cause stopping of the loom, thereby reducing the efficiency of the machine, or else give rise to faults, which are not detected by the loom control devices and will thus deteriorate the quality of the fabric being produced.

To try and overcome the problem mentioned in a), the applicant has already developed in the last years different improvements in the electromagnetic weft yarn stopping units adopted on measuring weft feeders for fluid jet looms: the most interesting solutions are those described and claimed in IT-U-209674, and in the recent EP-363938.

An attempt to solve the problem mentioned in b) had instead been made, always by the applicant, by adopting an additional device mounted in correspondence of the yarn guide eyelet at the outlet of the measuring weft feeder: this solution is described in EP-239055. Nevertheless, said device was not able to fully solve the problem in that, since the weft yarn was not blocked but merely deviated, it was still likely to loosen around the drum.

SUMMARY OF THE INVENTION

The present invention now proposes instead to thoroughly solve the problem by means of a totally new device, which is able to firmly block the weft yarn at the outlet of the weft feeder while its cutting takes place in the loom.

This device, which is to be associated to measuring weft feeders for fluid jet looms, just downstream of the outlet yarn guide and/or of the antiballoon device of said feeders, is characterized in that it comprises a single elongated body including: an inlet cone and a cylindrical channel, crossed by the weft yarn, the common axis of which is the longitudinal axis of said device; a core to block the weft yarn, movable into a guide perpendicularly to said axis and adapted to penetrate into said channel through an opening thereof; electromagnetic means acting on said core against a return spring; and a bush associated to said channel, in correspondence of said opening, to form a contrast surface onto which said core engages in order to block the weft yarn.

In said device, the core is suitably cylindrical and its diameter is wider than that of the channel crossed by the weft yarn, while the contrast surface of the bush comprises a bottom layer of damping material and a covering of shockproof and wear resistant material.

Preferably, the spring return means, which consist of a cylindrical helical spring, tend to keep the core in tight engagement with said contrast surface inside the channel, so as to block the weft yarn, while said electromagnetic means, which consisting of a coil surrounding said core, when energized, lead said core out of the channel, causing it to disengage from said surface and to release the weft yarn, leaving it free to cross the channel of the device.

In an active condition of the device, said electromagnetic means are de-energized slightly later than the issue of the last signal of weft yarn unwinding from the drum of the measuring weft feeder, so that, during weft yarn cutting in the loom, said yarn is blocked by the device, while the engagement of the core with the contrast surface of the channel still remains.

BRIEF DESCRIPTION OF THE DRAWINGS

Further characteristics and advantages of the device according to the present invention will anyhow be more evident from the following detailed description of a preferred embodiment thereof, given by way of example and illustrated on the accompanying drawings, in which.

DETAILED DESCRIPTION OF THE INVENTION

Figure 1:
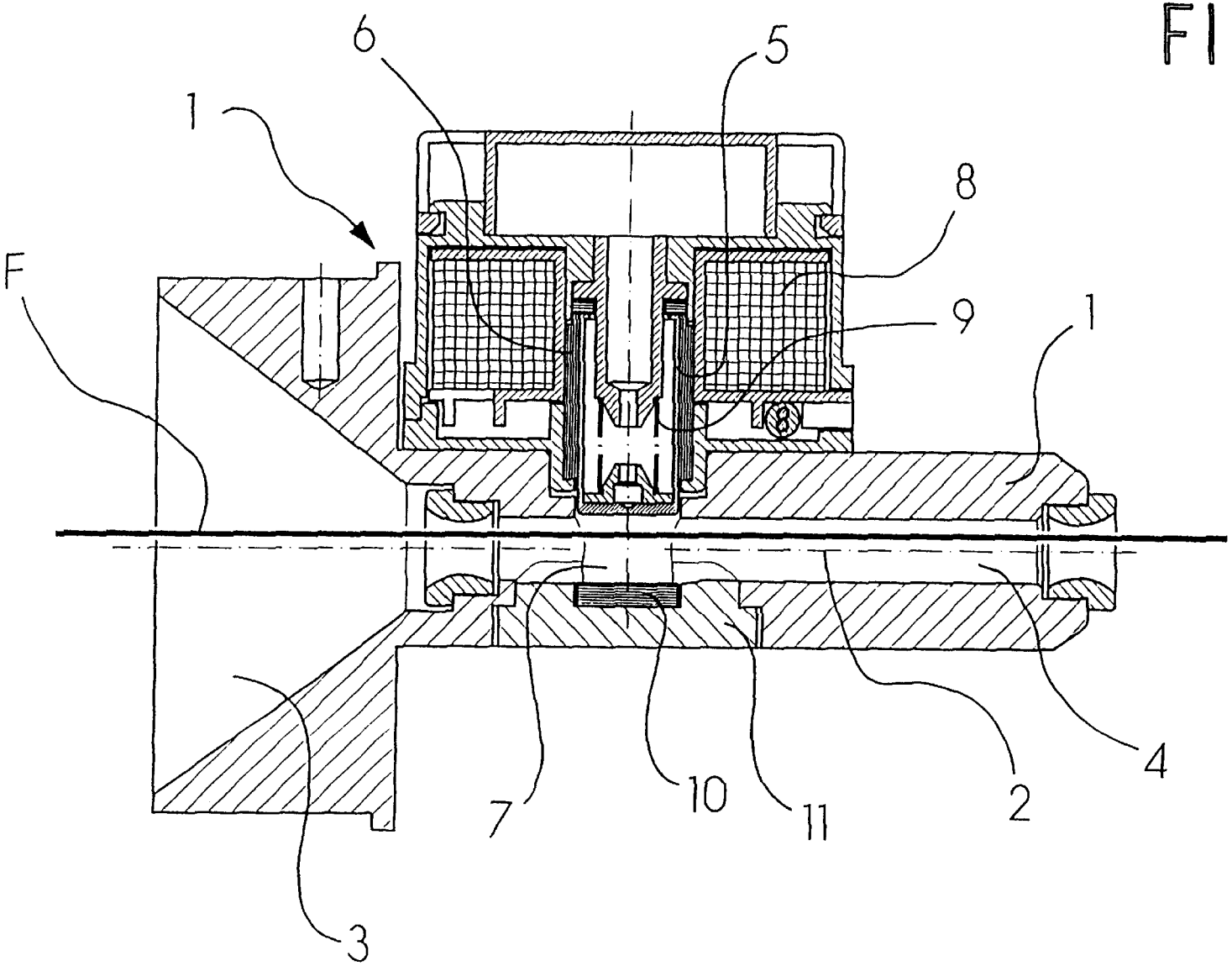
FIG. 1 is an axial section view of the device, showing the weft yarn blocking core and the spring means associated thereto in an inactive condition.

As shown on the drawings, the device to block the weft yarn of the present invention essentially consists of a single elongated body 1 with longitudinal axis 2, comprising an inlet cone 3 and a cylindrical channel 4 meant to be crossed by the weft yarn F, the cone 3 and the channel 4 being aligned with their axes coinciding with the axis 2 of the body 1. The device is meant to be associated to measuring weft feeders for fluid jet looms, to which it is applied by way of the cone 3 just downstream of the outlet yarn guide and/or of the antiballoon device of said feeders.

The body 1 of the device according to the invention comprises moreover a cylindrical core 5 to block the weft yarn F, movable into a guide 6 perpendicularly to the axis 2 and adapted to penetrate into the channel 4 through a transversal opening 7 thereof. Electromagnetic means in the form of a coil 8 surround the core 5, onto which there also acts a cylindrical helical spring 9. A bush 11 is associated to the channel 4 in correspondence of the opening 7, so as to form a contrast surface 10 onto which the core 5 engages in order to block the weft yarn F. The contrast surface 10 comprises a bottom layer of damping material and a covering of shockproof and wear resistant material.

Figure 2:
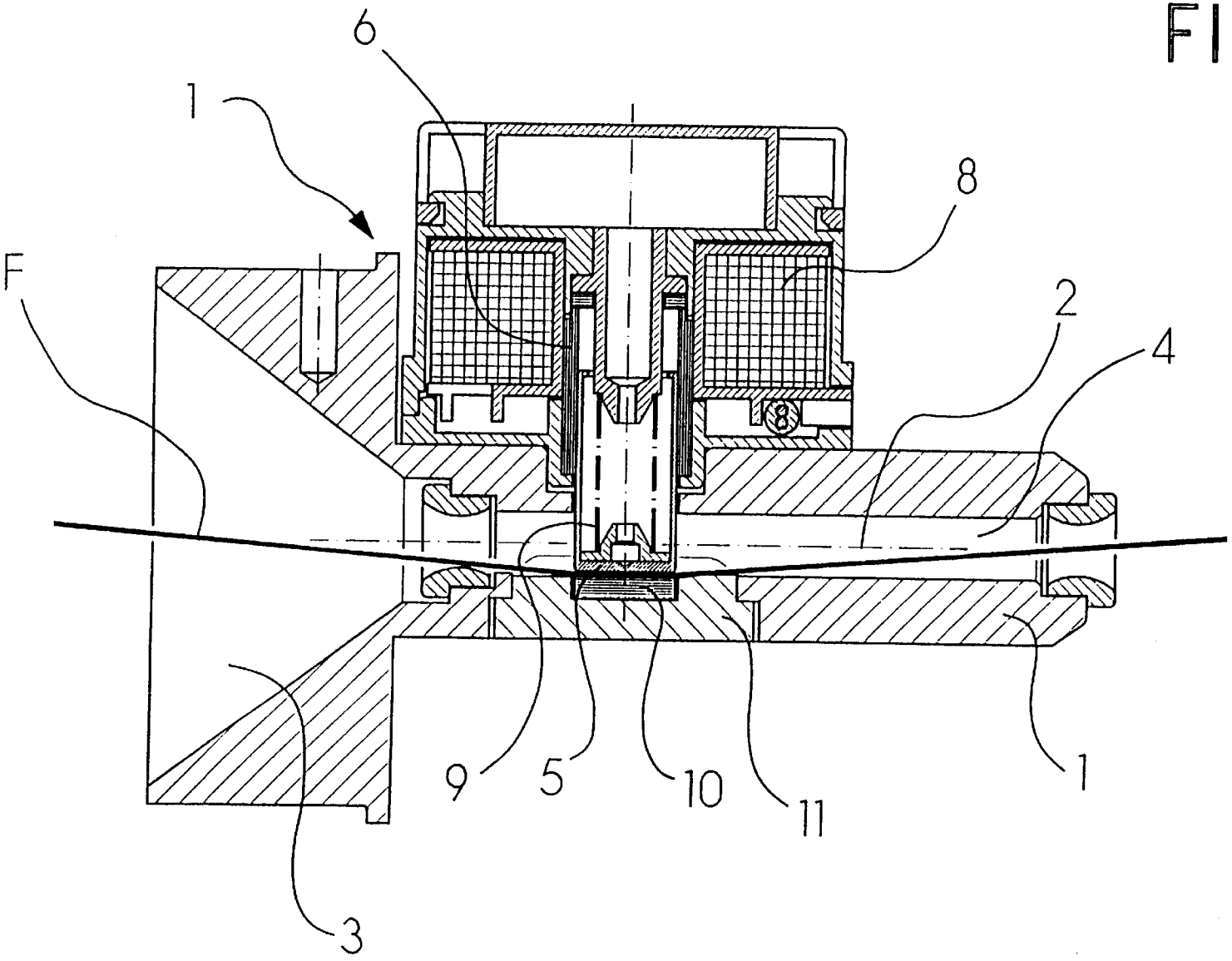
FIG. 2 is an axial section view of the device, showing the weft yarn blocking core and the spring means associated thereto in an active condition.

The device according to the invention is normally inactive (FIG. 1) to allow the weft yarn F to freely cross the channel 4. To keep said device in an inactive condition, it is necessary to energize the coil 8 which, overcoming the action of the return spring 9, causes the core 5 to move backward (as shown in FIG. 1) disengaging from the surface 10, and leads said core out of the channel 4. When the coil 8 is de-energized, the device becomes active (FIG. 2), in that the spring 9 pushes the core 5 into the opening 7 of the channel 4 (as shown in FIG. 2) and presses it against the contrast surface 10 of the bush 11, so as to block the weft yarn F, crossing said channel, between the core 5 and the surface 10.

The device according to the invention is inactive (FIG. 1) when the weft yarn F is being inserted into the loom; during this step, the yarn is free to slide through the channel 4, the core 5 being kept out of the opening 7 by the coil 8, suitably energized, which attracts it against the action of the return spring 9.

The device becomes active (FIG. 2) at the end of the weft yarn insertion step, by de-energizing the coil 8: the spring 9 thus moves the core 5 back into the opening 7 of the channel 4 so as to block the weft yarn F against the surface 10 of the bush 11. In this condition, the yarn can no longer slide through the channel 4, nor loosen around the drum of the measuring weft feeder.

The de-energizing of the coil 8, to turn the device active, is carried out somewhat later than the issue of the last signal indicating that the weft yarn turns have unwound from the drum of the measuring weft feeder, namely when the weft yarn has positively stopped (at the end of insertion in the loom), and before it is cut by the appropriate means provided in the loom. It is actually in this step that the weft yarn is kept firmly gripped between the core 5 and the contrast surface 10, and it remains in this condition during cutting and up to start of the following insertion.

The object of the invention is thereby reached. It is in fact just after the cutting step that the oscillations on the weft yarn may be produced, involving the previously described inconveniences. The device of the invention thus proves to be extremely helpful to eliminate such drawbacks, as it prevents undesired waves travelling backwards from the loom cutting devices through the launching nozzle from extending up to the weft yarn length between the yarn guide at the outlet of the measuring weft feeder (and now the device of the invention) and the yarn reserve drum, thereby ruffling the yarn turns wound thereon.

The core 9 is then returned to its inactive position by energizing the coil 8 and thus freeing again the channel 4 at the start of the next weft yarn insertion.

The device according to the invention is normally associated to a measuring weft feeder, so as to form an integrating part thereof, by way of its inlet cone 3 acting as an efficient element of connection with the antiballoon device usually provided at the outlet of said feeders. As an alternative, said device can be simply mounted downstream of the outlet yarn guide of the measuring weft feeder.

The device of the present invention is full of advantageous properties, which contribute to the efficient operation of the weft feeders to which said device is associated and of the looms adopting such feeders. In fact:

1) The device of the invention is adapted to complete a nozzle for the automatic insertion of the weft yarn, whereby, connected to other devices commonly used on measuring weft feeders for fluid jet looms, it allows to obtain the full insertion of the weft yarn from the inlet to the outlet of the feeder.

2) The device of the invention can be mounted on automatic systems provided to mend the weft yarn, wherein it may be required to launch the yarn through the weft feeder up to the loom nozzle.

3) The device of the invention can be easily connected at the outlet of a funnel-shaped antiballoon device.

4) Unlike the known plate brakes used in some types of looms, which always have a very limited stroke (reduced space between the two plates when the brake is open), the device of the invention, when inactive, leaves the channel crossed by the yarn totally free, and thus by no means hinders the sliding of the yarn during its insertion.

5) Since the channel is totally closed by the blocking core, when this latter is caused to act, and since the diameter of said core is wider than that of the channel, the inconvenience of the known plate brakes, caused by the weft yarn emerging from the plate, no longer arises with the device of the invention. In fact, with the known plate brakes, one was forced to use an inlet yarn guide eyelet, as well as an outlet one of small diameter, in order to keep the yarn guided under the plate, with evident limitations as far as the size of the yarn being used for weaving and the practicality of the manual yarn inserting operation.

6) The cleaning of the device of the invention is obtained thanks to the continuous passage of weft yarn, which constantly laps on the channel walls and simultaneously produces an air flow allowing to prevent the piling up of dust.

7) Downstream of the device of the invention, it is possible to associate a controlled weft recovery device at the outlet of the measuring weft feeder.

8) The device of the invention facilitates the operation of manual reinstatement of the weft yarn reserve, preventing when the yarn winding member starts to operate, said yarn from being pulled backward towards the weft feeder drum, thereby slipping out of the operator's hand and thus requiring to be inserted again into the antiballoon device, or into the yarn guide eyelet at the outlet of the feeder.

9) The device of the invention is controlled directly by the weft feeder and thus operates in full synchronism with the actual position of the weft yarn, with no need to use any further mechanical elements connected to the loom, or any sensors or signals to establish said synchronism.

It is understood that there may be other practical embodiments of the device according to the present invention, differing form the one described heretofore, but still falling within its scope. In particular, the action of the device and of the core to block the weft yarn can be obtained through electromagnetic means, instead of spring means, while spring means could be used to stop the action of said device; likewise, use could be made of electromagnetic means, either on their own, or combined with spring means, both to make the device active and to keep it inactive.

I claim:

1. Device for blocking weft yarn associated with a measuring weft feeder for fluid jet looms, said device adapted to be located just downstream of at least one of an outlet yarn guide and an antiballoon device of said feeder, the device comprising: a single elongated body which includes: an inlet cone and a cylindrical channel, crossed by the weft yarn, said inlet cone and cylindrical channel having an axis which is common to the longitudinal axis of said device; a core for blocking the yarn, said core being movable into a guide perpendicularly to said axis and adapted to penetrate into said channel through an opening thereof; an electromagnetic means acting on said core against spring return means; and said channel having, in correspondence of said opening, a bush which forms a contrast surface onto which said core engages in order to block the yarn.

2. Device according to claim 1, wherein said core is cylindrical and has a diameter which is wider than that of the channel crossed by the yarn.

3. Device according to claim 1, wherein said contrast surface of the bush comprises a bottom layer of damping material, and a covering of shockproof and wear resistant material.

4. Device according to claim 1, wherein said spring return means urges the core in engagement with said contrast surface inside the channel, blocking the yarn, while said electromagnetic means, when energized, lead said core out of the channel, causing it to disengage from said surface and to release the yarn.

5. Device according to claim 1, wherein said spring return means consists of a cylindrical helical spring.

6. Device according to claim 1, wherein said electromagnetic means consist of a coil surrounding said core.

7. Device according to claim 1, including means for de-energizing said electromagnetic means just after an indication of weft yarn unwinding from a drum of the measuring weft feeder, so that during weft yarn cutting in the loom, said yarn is blocked by the device.

* * * * *